United States Patent [19]

Bordenga

[11] Patent Number: 4,921,356

[45] Date of Patent: May 1, 1990

[54] AUTOMATIC STIRRER

[76] Inventor: Giovanni Bordenga, 2185 N. Normandy Blvd., Deltona, Fla. 32725

[21] Appl. No.: 344,957

[22] Filed: Apr. 28, 1989

[51] Int. Cl.[5] ..... B01F 7/16

[52] U.S. Cl. ..... 366/343; 366/285

[58] Field of Search ..... 99/348; 366/241, 245, 366/247, 249, 251, 179, 285, 281, 282

[56] References Cited

U.S. PATENT DOCUMENTS

| | | | |
|---|---|---|---|
| 723,977 | 3/1903 | Barney | 366/282 |
| 3,357,685 | 12/1967 | Stephens | 366/282 |
| 3,697,053 | 10/1972 | Will | 366/281 |
| 4,151,792 | 5/1979 | Nearhood | 99/348 |
| 4,184,779 | 1/1980 | Detmer | 366/282 |

*Primary Examiner*—Robert W. Jenkins

*Attorney, Agent, or Firm*—Richard C. Litman

[57] ABSTRACT

A stirring apparatus that can be used to stir food while it is cooking. The present invention also affords the user with a great deal of adaptability as it can accommodate a large variety of pot sizes. The continuous stirring nature of the present invention improves the quality, color, and taste of the food items which it stirs, because the stirrer rotates constantly while the food is cooking. Moreover, the present invention reduces cleanup time and effort as the food in the pot is less likely to stick to the sides and leave hard-to-remove residues.

7 Claims, 1 Drawing Sheet

15a
14
12
13a
13
15
10
12a
19
18
11
16
17

AUTOMATIC STIRRER

BACKGROUND OF THE INVENTION

1. Field of the Invention

The present invention relates to an electrical, automatic stirrer. More specifically, the present invention relates to those stirrers that can be mounted on top of pots of various sizes and can be used to stir the contents of the pot while the contents are cooking.

2. Description of the Prior Art

The primary difficulty encountered in the food service industry is the need to keep large pots of food hot during the course of a sitting of a meal. At present, should a restaurant wish to keep a food item palatable for long periods of time, the chef is required to periodically stir the contents of the pot to prevent burning of those contents. Not only is this time consuming for the chef who may be busy with any number of alternate tasks, but the food has a tendency to settle within the pot, discolor, and lose some of its taste.

The present invention provides a solution to this problem by continuously stirring the contents of a pot while the contents are cooking. Since the stirring is provided by an automatic motor, the chef need not concern himself with the mundane task of stirring by hand every few minutes.

In addition to the aforementioned feature, the present invention offers adaptability. The food stirrer can be adapted to fit over the opening of a wide variety of pot sizes. In a large kitchen where pot sizes may vary considerably depending upon the particular use, this feature can be very useful.

The present invention also offers a basket arrangement thereattached. This basket can hold any number of items such as soup bones, meat, vegetables, and spices that are needed to flavor the particular food item. The basket suspends these materials within the pot, yet it keeps them from mixing with the item to be served. In addition, it prevents large items such as bones from interfering with the stirring action of the stirring paddle.

There have been a number of developments of stirrers in the past, however, none address this specific problem. Moreover, none address the problem of stirring the contents of a container in the manner of the present invention.

U.S. Pat. No. 1,085,858 issued to W. H. Fulton on Feb. 3, 1914 discloses a stirrer that can be adapted to any number of pot sizes. Fulton accomplishes this by providing clamping means to the stirrer. However, the Fulton device is limited in application as it is designed for high speed stirring.

U.S. Pat. No. 2,700,534 issued to M. R. Pegues on Jan. 25, 1955 is perhaps the closest reference to the present invention. Pegues discloses a stirring apparatus that is designed to stir food while cooking. However, Pegues is limited to one pot size only. The same stirring device cannot be adapted to a variety of pot sizes. The only manner in which the device could be adapted to different pot sizes would be to have a separate device for each pot size. Clearly this provides a substantial inconvenience.

SUMMARY OF THE INVENTION

Therefore, it is an object of the present invention to provide an automatic stirrer that can be adapted to a variety of pot sizes.

It is still another object of the present invention to provide a stirring device that can stir food while it is cooking.

It is yet another object of the present invention to provide a stirring apparatus that provides stirring at a multitude of speeds. However, primarily, the present invention provides slow stirring of food for even cooking without splattering.

It is another object of the present invention to provide a stirring device that prevents burning of the food contents of the pot. As a result, the food quality, color, and taste are improved. Moreover, the pot need not be scrubbed after use as there will be a substantial reduction in the food adhered to the interior of the pot. Logically, this reduces the need for chemicals and scouring devices as there is not a substantial amount of residue left in the pot after use.

It is still another object of the present invention to provide a basket suspended within the pot to contain meat, bones, vegetables, and spices. This allows the food in the pot to absorb the flavor of the items contained within the basket. It also prevents these items from impeding the stirring of the apparatus.

It is another object of the present invention to provide a plastic stirring paddle. Metal stirrers may taint food items with a metallic taste if left within the food item. This is especially true when dealing with acidic foods such as soups.

It is still another object of the present invention to provide a plastic stirrer that can be replaced with similar paddles of differing sizes. Such a design allows replacement of the stirrer with others of similar kind such that maximum stirring can be achieved in all pot sizes.

It is another object of the present invention to provide a stirring apparatus that can be disassembled easily. This allows for easy cleaning of the apparatus once used.

With these and other objects in view which will more readily appear as the nature of the invention is better understood, the invention resides in the novel combination and arrangement of parts hereinafter more fully described and illustrated, with reference being made to the accompanying drawings.

BRIEF DESCRIPTION OF THE DRAWINGS

Similar reference characters designate corresponding parts throughout the various figures of the drawings.

DESCRIPTION OF THE PREFERRED EMBODIMENT

Figure 1:
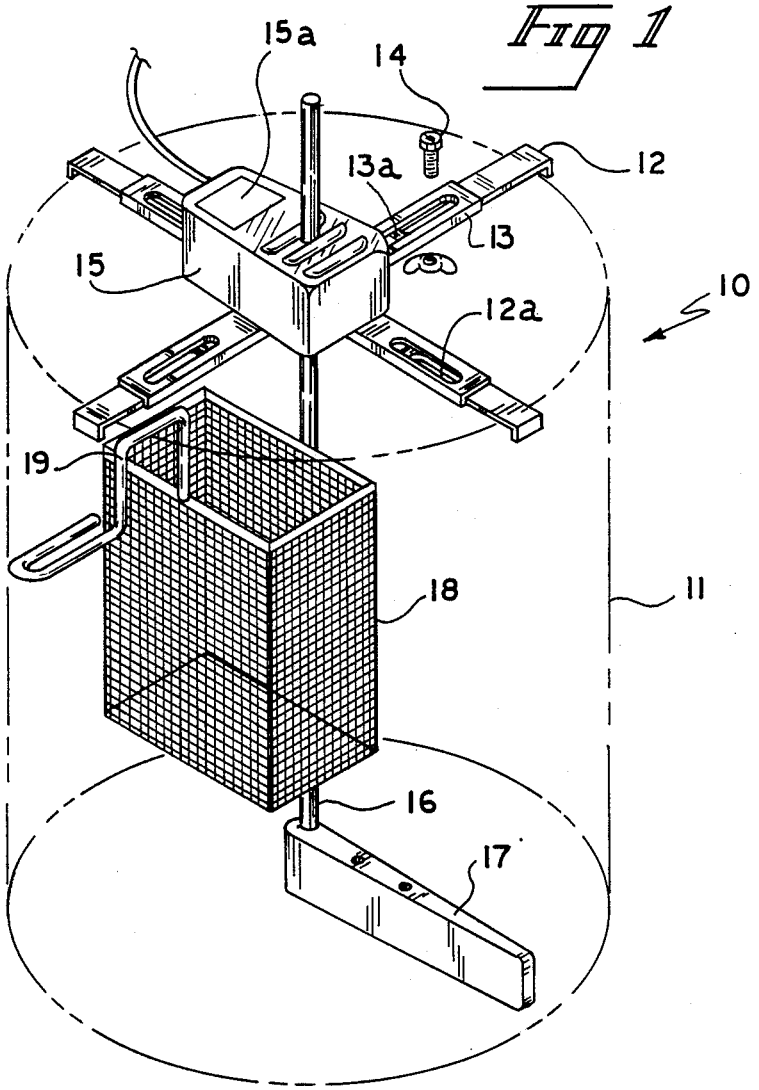
FIG. 1 is a perspective illustration of the present invention in use.*

The present invention is generally designated 10 in FIG. 1. The stirrer 10 is designed such that it can be suspended over a container 11. The stirrer 10, because of its specific design, removably attaches from and rests upon the lip of the container 11 to which it corresponds.

The stirrer 10 is essentially composed of a motor 15, a stirring shaft 16, and a stirring paddle 17. The motor 15 has extending from it a number of fixed guide tracks 13. These fixed guide tracks 13 are rectilinear members having a hollow center portion in which an extensible member 12 may be inserted. Since the extensible member 12 slidably extends from the fixed guide track 13, it can be adjusted to accommodate any diameter of container 11. A threaded screw 14 is displaced through both the fixed guide track 13 and the extensible member 12 to allow rigid fixing of the extensible member 12 when necessary. Screw 14 also acts as a stop means to prevent the extensible member 12 from being disengaged from the guide track 13.

Both the fixed guide track 13 and the extensible member 12 are provided with a longitudinal slots 12*a*,13*a*. The longitudinal slots 12*a*,13*a* are hollow elongated holes 12*a*,13*a* through both of the two members. The longitudinal slots 12*a*,13*a* allow for slidable motion of either the fixed guide track 13 or the extensible member 12 when the threaded screw 14 is displaced therethrough. In FIG. 1, the longitudinal slots 12*a*,13*a* are shown in the fixed guide track 13 an extensible member 12.

The basket 18 can be suspended from the rim of the container as shown in FIG. 1. The basket handle 19 provided with a U-shape hangs over the rim while sticking out away from the pot. This allows the user of the device to grab the basket and strain it separately. Of course any alternate means obvious to those skilled in the art also applies. The basket 18 is provided to hold any large particulate matter suspended within the interior of the container 11. The basket 18 can be filled with such things as meat bones, spices, or any material usually employed in the cooking of food stuffs. The basket 18 prevents these large particulates from settling to the bottom of the container and interfering with the rotational motion of the stirring paddle 17 provided.

The stirring paddle 17 is disposed along the length of the stirring shaft 16 extending from the motor 15. It is preferred that the stirring paddle 17 be composed of a plastic material so as not to interfere with the taste of the food. It is well known to those in the art of cooking that metallic object placed in a cooking substance for any extended period of time, especially one which is acidic (such as spaghetti sauce), may leave an unwanted taste of metal therein. Of course, any suitable substance is acceptable for the composition of the stirring paddle 17, and the present invention should not be considered to be limited to the materials provided.

The stirring paddle 17 is provided with a hole through one of its ends. This hole allows the stirring paddle 17 to slide onto the stirring shaft 16 easily but fixedly. As a result, the stirring paddle 17 can be disposed anywhere along the length of the stirring shaft 16 for maximum stirring effect. It is even conceivable that a number of stirring paddles 17 may be disposed along the stirring shaft 16 to increase the stirring effect of the apparatus. Alternatively, the stirring paddle 17 may be provided with a series of holes along its length to provide different stirring effects depending upon the material being stirred.

The motor 15 that sits atop the stirring apparatus 10 is a standard motor providing rotational speed to the stirring shaft 16. The stirring shaft 16 could also be provided with means enabling it to adjust to any particular pot depth. Shaft 16 is shown in FIG. 1 extending through the motor 15 such that the shaft depth in the pot can be adjusted by sliding the shaft through the motor 15. Preferably, the motor 15 speed is sufficiently slow to avoid spilling the contents of the container 11. Moreover, the motor 15 may be of such a construction to provide a multitude of alternative speeds for a variety of applications. The motor 15 may be plugged into an A/C wall socket, or it may be run by D/C battery power located therein accessible through the battery compartment door 15*a*.

The stirring apparatus 10 herein described is specifically designed for the stirring of foods while cooking. The operation of the stirring apparatus 10 will improve the quality of the food stirred in that the food will not have the opportunity to settle and burn to the interior of the container 11. Additionally, the continual stirring of the contents of the container 11 will help out the chef using the device as he or she will not need to return to the container to stir its contents at all. The container 11 is also protected by the use of the automatic stirrer 10. As there is a reduced amount of food deposits on its interior, the container 11 requires less cleaning and scrubbing, and therefore, the container is subjected to less wear and tear.

It is to be understood that the present invention is not limited to the sole embodiment described above, but encompasses any and all embodiments within the scope of the following claims.

I claim:

1. An apparatus for stirring substances in a container comprising:

a stirring paddle, said stirring paddle affixed at a predetermined point along the length of a stirring shaft, said stirring shaft extending from and through a motor means providing rotational motion and depth adjustment to said stirring shaft, said motor means having at least two fixed guide tracks attached thereto, said fixed guide tracks defining a hollow center region wherein an extensible member may be inserted, said extensible member being substantially L-shaped allowing for removable engagement of said apparatus with said container, wherein the slidable engagement of said extensible member with said fixed guide track allows said apparatus to adapt to substantially any diameter of said containers, and said extensible member having a stop means attached thereto preventing the inadvertent, complete removal of said extensible member from said hollow center region of said fixed guide tracks.

2. An apparatus for stirring substances in a container according to claim 1, wherein:

said stirring paddle is removable from said stirring shaft.

3. An apparatus for stirring substances in a container according to claim 1, wherein:

said motor means is energized through a connection with a standard electrical outlet.

4. An apparatus for stirring substances in a container according to claim 1, wherein:

said motor means has an independent energy supply therein provided.

5. An apparatus for stirring a substance in a container according to claim 1 further comprising:

a basket suspended from the side of said container and extending into said container, and wherein said basket comprises a porous material allowing said substance being stirred to intermix with the contents therein.

6. An apparatus for stirring a substance in a container according to claim 1, wherein:

said motor means provides a continuous rotational motion providing minimum stirring.

7. An apparatus for stirring a substance in a container according to claim 1, wherein:

said motor means provides a plurality of rotational speeds.

* * * * *